US009199754B2

(12) United States Patent
Figer et al.

(10) Patent No.: US 9,199,754 B2
(45) Date of Patent: Dec. 1, 2015

(54) STORAGE DEVICE FOR BINDING WIRE OF A CORDING MACHINE

(75) Inventors: Ute Figer, Frohnleiten (AT); Walter Writzl, Graz (AT); Manfred Wöls, Etmissl (AT); Josef Kammerhofer, Aflenz (AT)

(73) Assignee: Andritz AG, Graz (AT)

( * ) Notice: Subject to any disclaimer, the term of this patent is extended or adjusted under 35 U.S.C. 154(b) by 727 days.

(21) Appl. No.: 12/737,605

(22) PCT Filed: Jul. 24, 2009

(86) PCT No.: PCT/AT2009/000287

§ 371 (c)(1), (2), (4) Date: Mar. 21, 2011

(87) PCT Pub. No.: WO2010/012016

PCT Pub. Date: Feb. 4, 2010

(65) Prior Publication Data

US 2011/0168036 A1 Jul. 14, 2011

(30) Foreign Application Priority Data

Jul. 31, 2008 (AT) ..... A 1189/2008

(51) Int. Cl.

*B65B 13/18* (2006.01)
*B65H 51/20* (2006.01)
*B65H 20/34* (2006.01)

(52) U.S. Cl.

CPC ..... *B65B 13/184* (2013.01); *B65H 20/34* (2013.01); *B65H 51/20* (2013.01)

(58) Field of Classification Search

CPC ..... B65H 51/20; B65H 20/24; B65H 20/34; B65H 2408/2171; B65H 2408/2172; B65H 2408/2173; B65H 2408/216; B65H 2408/217; G03B 27/46; G03B 1/54; B65B 13/184; B65B 13/187; B65B 13/22

USPC ..... 100/2, 34, 24, 26, 29, 31, 32; 140/93.6, 140/113, 116, 119; 492/28, 36, 33, 35; 226/24, 118.2, 118.3, 118.4, 189; 242/417.3, 418.1, 418.2; 292/101, 202, 292/330

See application file for complete search history.

(56) References Cited

U.S. PATENT DOCUMENTS

| | | | | | |
|---|---|---|---|---|---|
| 2,725,974 | A | * | 12/1955 | Shields | 198/840 |
| 3,946,921 | A | * | 3/1976 | Noguchi | 226/43 |
| 4,009,814 | A | * | 3/1977 | Singh | 226/113 |
| 4,154,158 | A | * | 5/1979 | Leslie et al. | 100/2 |

(Continued)

FOREIGN PATENT DOCUMENTS

| | | |
|---|---|---|
| EP | 2 310 274 B1 | 6/2012 |
| WO | WO 01/68450 | 9/2001 |
| WO | WO 01/68450 A2 | 9/2001 |

*Primary Examiner* — Jimmy T Nguyen
(74) *Attorney, Agent, or Firm* — Alix, Yale & Ristas, LLP

(57) ABSTRACT

An accumulator device (1) for the tying wire of a tying machine used in pulp production has a drive (3) at the inlet to the accumulator device and another drive (7) at the outlet from the accumulator device. By means of the accumulator device (1) according to the invention and the two drives (3, 7), it is possible to store the entire length of wire required for one tying cycle temporarily and then to remove the wire from the accumulator for the tying cycle. In this way, a dynamic accumulator volume is created for the tying wire in the accumulator device (1).

11 Claims, 3 Drawing Sheets

(56) References Cited

U.S. PATENT DOCUMENTS

| | | | | | |
|---|---|---|---|---|---|
| 4,215,827 | A | * | 8/1980 | Roberts et al. | 242/364.3 |
| 4,356,946 | A | * | 11/1982 | Gaskell | 226/117 |
| 4,512,844 | A | * | 4/1985 | Kobiella | 156/510 |
| 4,554,779 | A | | 11/1985 | Fischer | 53/589 |
| 4,690,349 | A | * | 9/1987 | Yamaguchi et al. | 242/420.6 |
| 4,938,009 | A | * | 7/1990 | Takami | 53/589 |
| 5,139,206 | A | | 8/1992 | Butler | |
| 5,169,479 | A | * | 12/1992 | Hoddinott et al. | 156/355 |
| 5,236,329 | A | * | 8/1993 | Sylvester | 53/399 |
| 5,413,264 | A | * | 5/1995 | Kotzur et al. | 226/42 |
| 5,826,472 | A | * | 10/1998 | Tamura et al. | 83/72 |
| 6,050,517 | A | * | 4/2000 | Dobrescu et al. | 242/417.2 |
| 6,546,696 | B2 | | 4/2003 | Cranston, III et al. | |
| 7,770,369 | B2 | * | 8/2010 | Doyle et al. | 53/589 |
| 2004/0200191 | A1 | * | 10/2004 | Armstrong et al. | 53/399 |

* cited by examiner

STORAGE DEVICE FOR BINDING WIRE OF A CORDING MACHINE

CROSS-REFERENCE TO RELATED APPLICATIONS

This application is the U.S. National Stage entry under 35 U.S.C. §371 from International Application PCT/AT2009/000287 filed Jul. 24, 2009.

BACKGROUND

The invention relates to an accumulator device for tying wire in a tying machine, particularly for pulp production, with an inlet to the accumulator device and an outlet from the accumulator device, and with a drive for tying wire.

In addition, the invention relates to a process for feeding the tying wire through an accumulator device to a tying device, particularly for pulp production, where the tying wire is fed through an inlet into the accumulator device and through an outlet out of the accumulator device to the tying device.

Tying machines are used in bale finishing lines in pulp production. Here, pulp bales (wrapped in pulp wrapping sheets or without wrapping), pulp stacks (3-4 bales with a total weight of approximately 1 metric tonne) or pulp units (2 stacks) are tied together with galvanized steel wire. Whenever bales are mentioned below, this can either mean pulp bales, pulp stacks or pulp units. The function of the tying machine is to transport a bale into the machine, apply up to nine steel wires per bale, and transfer the bale to the subsequent conveying device. The tying process involves winding the wire round the bale, drawing the wire taut, knotting the wire, and cutting the wire off the wire roll.

There are plants where the tying wire is pulled off a roll, threaded through an accumulator device, and then fed to a tying frame in which the pulp bales are tied up as described above. When it is wound round the bale, the wire is threaded around the bale in a tying frame. The wire loop closes in a tying head, containing a so-called twister, a gripper, and a cutter unit. Here the wire end that is still attached to the wire coming from the roll comes to rest on top of the leading wire end. As the wire is drawn taut, the wire end is clamped firmly in the gripper and the loop is pulled tight around the bale. The two wire ends are then twisted in the twister and the wire end is cut off from the rest of the wire.

A device of this kind is known from WO 01/68450 A2. In this device, the wire coming from the roll is fed through an accumulator drum to the tying frame. When the wire is drawn taut, the wire running into the accumulator drum is axial direction is wound round the accumulator drum. Here, the wire is wound round its own axis. Due to the very short cycle times, the wire forward feed speeds are currently up to 200 m/min., which results in consideration wear on the wire guides. If the wire is now also wound round its own axis, this leads to lateral displacement, which increases wear further. Moreover, the wire must have a relatively large diameter, currently around 3 mm, in order to provide the necessary stiffness required for the wire to be pushed easily through the guiding devices. A machine for tying up packages is known from EP 0 129 117 A1, using plastic tapes with little stiffness that have to be drawn round the package. U.S. Pat. No. 3,946,921 describes an accumulator for packing machines that also uses plastic tapes. In addition, DE 102 07 646 A1 shows temporary accumulator for a tying tape, i.e. also a material with little stiffness. The problems and solutions present here cannot be transposed to stiff tying wire.

A further problem is caused by the relatively high dynamic forces generated at high forward feed speeds of up to 200 m/min. when the wire or the drum on which it is wound is accelerated and braked.

SUMMARY

The problem thus addressed by the present invention is to provide an accumulator device with the simplest possible design.

By means of the accumulator device described in the invention it is possible to accumulate the quantity of wire required for one tying procedure and then pull it out of the accumulator device for tying. Thus, the supply of wire from the accumulator device into the typing frame can be uncoupled from the wire being fed from the roll into the accumulator device. This not only simplifies control of the machine, it also relieves the strain on the drive units and the tying wire by uncoupling them from wire movement upstream, and downstream of the accumulator device. In addition, the tying wire does not have to be bent several times in different directions, as is known from the device in WO 01/68450 A2.

The invention allow embodiments and forms of implementation, respectively, where the process of threading the tying wire into the accumulator device and of removing the tying wire from the accumulator device can take place consecutively or overlapping concurrently. Similarly, the process of feeding the tying wire into the accumulator device can be conducted largely continuously and the process of removing the tying wire from the accumulator device can be conducted intermittently.

This means that the wire can be taken from the roll ahead of the accumulator device more or less continuously and without any substantial acceleration and/or deceleration, while still ensuring that the wire can be fed independently thereof from the accumulator device into the tying device very dynamically.

An initial preferred embodiment of the invention is characterised by two rolls or groups of rolls being placed in the accumulator device and round which the tying wire is wound at least twice, where the rolls have an adjustable centre distance. In this embodiment, the tying wire is threaded precisely round the two rolls or groups of rolls in order to guarantee trouble-free operation.

An arrangement in which the two rolls or groups of rolls are mounted vertically one above the other is an advantage here because the accumulator device then requires less floor space.

A second preferred embodiment of the invention is characterised by the accumulator device being a plate-type accumulator that forms a cavity in which the tying wire is held loose.

Plate-type accumulators of this kind, which are known from the state of the art and used to hold excess wire temporarily while the wire is tightened after being wound round the bales, normally consist of a flat box with two large, parallel side walls very close to one another, the spacing being less than twice the diameter of the wire. In this plate-type accumulator the wire is pushed in loose by the drive on the inlet side and pulled out again by the drive on the outlet side. As this plate-type accumulator has no moving design elements, it requires very little engineering design work, and there is also no need to take account of additional mass to be moved when considering the feed and discharge speed and the dynamics.

This embodiment also bears the advantage according to the invention that removal of the wire from the drum or other accumulator device can be uncoupled dynamically from wire feed to the tying device.

Further characteristic features and advantages of the invention are described in the following description of preferred embodiment examples of the invention, referring to the drawings.

DETAILED DESCRIPTION

Figure 1:
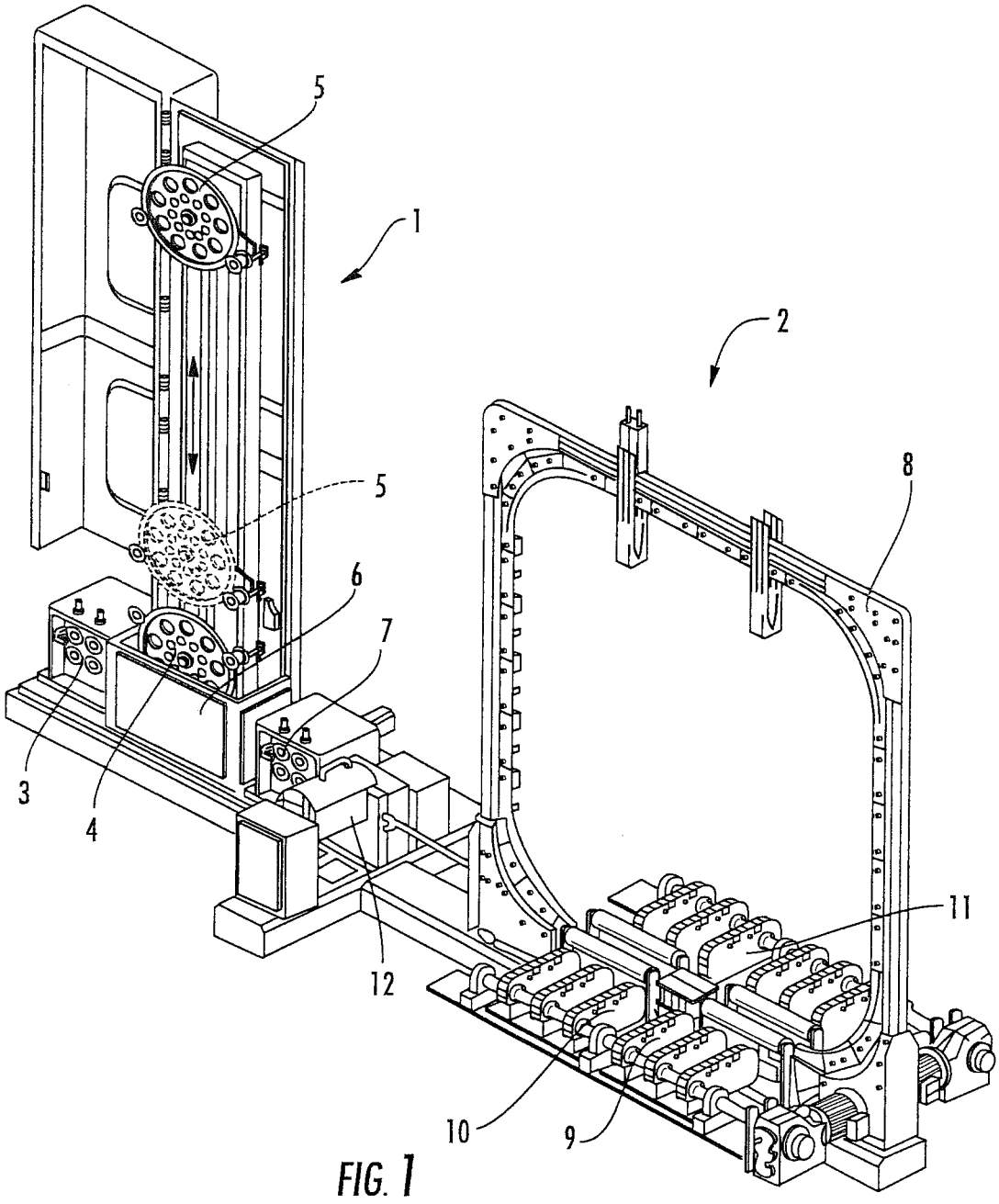
FIG. 1 a device for typing up bales, with a first embodiment of an accumulator device according to the invention, FIG. 2 a front view of the accumulator device, FIG. 3 a sectional view of the accumulator device along the line marked III-III in FIG. 2, FIG. 4 a front view of a second embodiment of an accumulator device according to the invention, and FIG. 5 an oblique view of the embodiment shown in FIG. 4.

FIG. 1 shows a tying machine for tying up pulp bales with galvanized steel wire, essentially comprising an accumulator device 1 and a tying device 2. The tying wire used to tie up the bales is fed from the left-hand side from a drum, tower, or similar, not shown here, to the first embodiment of an accumulator device shown in FIGS. 1 to 3 by being taken from the drum by a first drive 3. The tying wire not shown in the drawing then runs several times (three times in the example shown) round two groups of rolls 4, 5, after which a second drive 7 feeds it to the tying frame 8. The roll groups 4, 5 each consist of discs arranged coaxially one beside the other, which can be pivoted independently of one another and which have a channel in their circumferential surface to guide the tying wire.

In the tying frame 8, the tying wire runs once in anticlockwise direction by a little more than 360° round the bales stacked in the tying frame 8 until the wire end comes to rest in a tying head 9, which as a so-called twister, a gripper, and a cutter unit, and is lying on top of the following wire coming from the accumulator device 1. In order to draw the wire taut, the wire coming from the accumulator device 1 is clamped firmly in the gripper and pulled back in the opposite direction, causing the wire to be pulled out of the guides in the tying frame 8 and the loop to be tightened round the bale. The wire end is then twisted together in the twister with the wire end coming from the accumulator device 1 and the loop is cut off from the rest of the wire. The design of the tying frame 8 is known as such and thus, is not described in detail.

This process can be repeated up to nine times for bales if needed due to the size and structure of the bales. The bales are supplied on conveying devices 10, 11 at right angles to the plane in which the tying frame 8 extends, conveyed onwards in stages according to the number of tying wires to be applied, and then conveyed out of the tying frame 8 again.

A compacting device 12 for the leftover wire is located between the accumulator device 1 and the tying device 2. This is provided in order to roll up leftover wire, which is the end of a length of wire that has been unrolled entirely from the drum but is not long enough to tie up a bale, so that it can be disposed of more easily.

Figure 2:
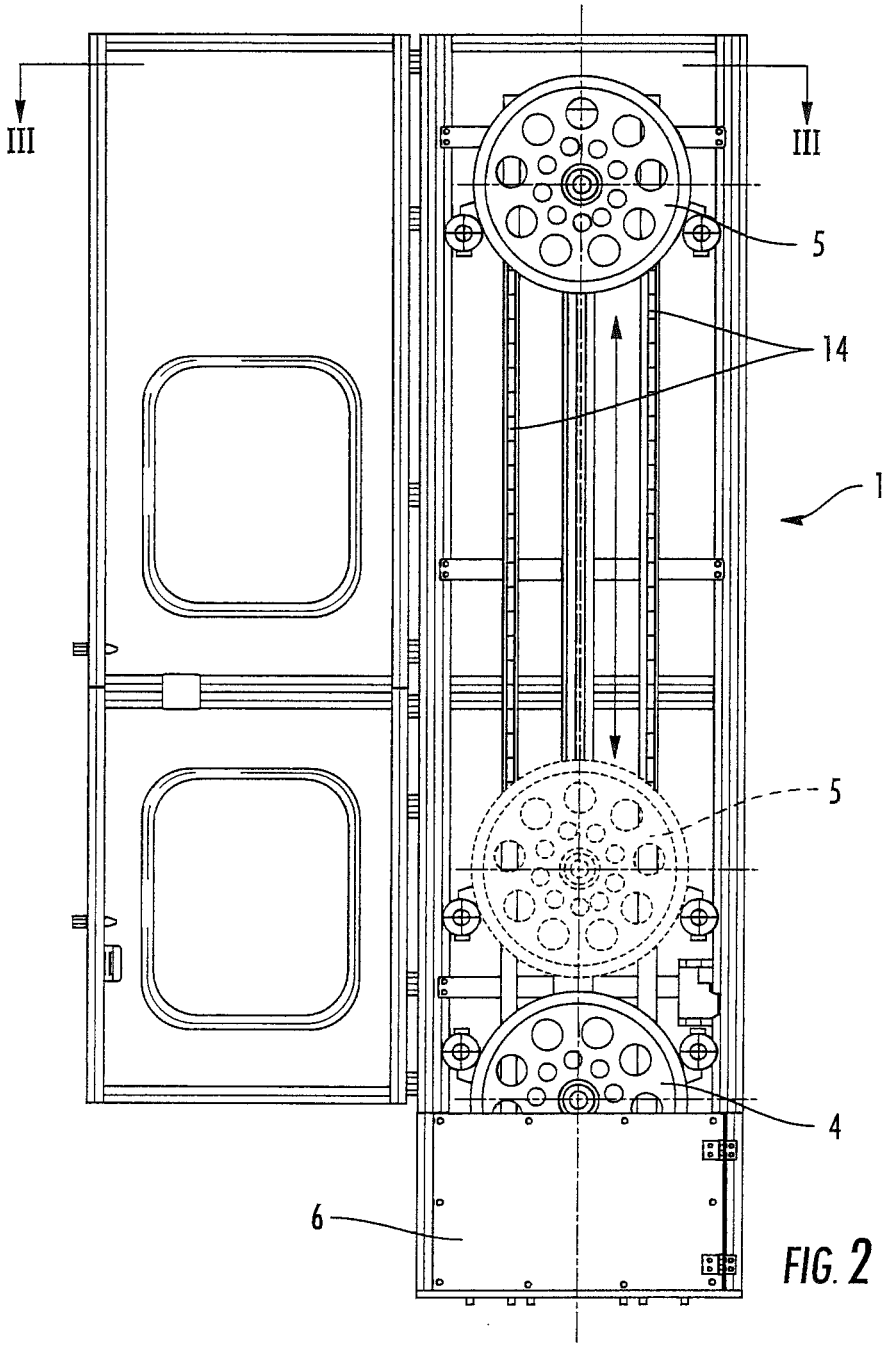
Figure 3:
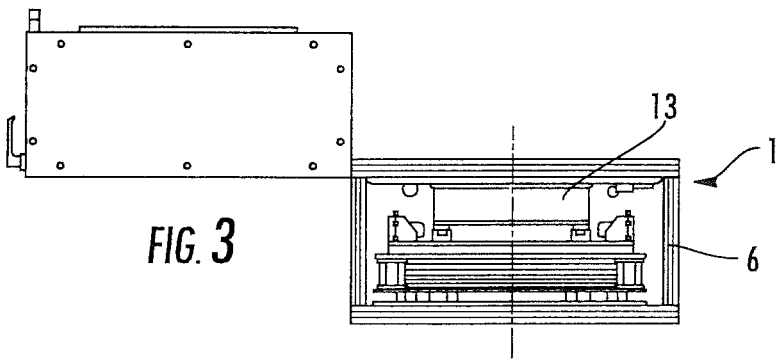

The accumulator device 1 in the embodiment according to FIGS. 1 to 3 has two groups of rolls 4, 5 as already mentioned, where the bottom roll group 4 is supported in a fixed mounting in a frame 13. In addition, the frame 13 has a guide 14 on which the top roll group 5 can be moved up and down vertically.

Finally, the accumulator device 1 also has a cabinet 6, shown with the door open, which holds the guide 14 and the roll groups 4, 5. The uppermost position of the movable roll group 5 is illustrated by continuous lines and the bottommost position by broken lines. After the drive 3 has removed the wire from the drum, the wire is pushed into the accumulator device 1 from the left-hand side, then it is turned through 90° round a first disc in the bottom roll group 4 before being looped several times, three times in the example shown, round the other discs in the two roll groups 4 and 5, and subsequently pulled out of the accumulator device 1 to the right-hand side by the drive 7 after the final disc in the bottom roll group 4. The number of loops formed round the two roll groups 4 and 5 depends on the one hand on the length required for looping round the bales and, on the other hand, on the travelling distance of the top roll group 5. In other words, the difference between the length of wire looped round the two roll groups 4 and 5 in the position in which the two roll groups 4 and 5 are farthest apart must at least equal the wire length needed for winding round the bale in the tying frame 8.

In place of roll groups it is possible to use only one stationary and one sliding roll, each of which has a number of channels equal to the number of loops around the centerline and through which the tying wire will slide as a result of the different wire speeds of the individual loops. FIG. 3 shows the top of roll 5 comprising three discs arranged coaxially one beside the other with respective channels 23*a*, 23*b*, and 23*c*, and also represents a roll with three grooves or channels.

The drive for the movable roll or roll group 5 can be a spring or a pressurizing cylinder, e.g. a pneumatic cylinder, that always pushes the movable roll or roll group 5 away from the stationary roll or roll group 4 in such a way that wire looped several times round the rolls or roll groups 4, 5 is always taut and the movable roll or roll group 5 is moved away from the stationary roll or roll group 4 automatically when wire is fed in.

The tying sequence for bales can be as follows, for example: The roll group 5 is in the bottommost position if the entire supply of wire in the accumulator device 1 was required in the previous tying procedure. The drive 7 is stopped so that the wire can be held in place by the drive 7. Then the drive 3 is started up, causing wire to be removed from the drum and pushed into the accumulator device 1. When this happens, the top roll group 5 moves upwards until it reaches its uppermost position. Theoretically it would also be possible to stop the drive 3 sooner if a shorter length of wire is required for looping round the bales.

Then drive 3 is stopped and drive 7 is started up, causing wire to be pulled out of the accumulator device 1. Since the drive 3 has been stopped and is holding the wire, the top roll group 5 moves downwards. The drive 7 pushes wire into the tying frame until it is full and the end of the wire comes to rest on the wire coming from the accumulator device 1. Now the direction of the drive 7 is reversed to tighten the wire loop round the bale until it is resting directly on the bale surface. Then the gripper is actuated, the end of the wire in the twister is twisted together with the wire coming from the accumulator device 1, and the fully twisted wire loop is cut off to detach it from the wire coming from the accumulator device 1. While the loop is being tightened round the bale, a length of wire is pushed back into the accumulator device 1, causing the roll group 5 to move upwards again a little. Finally, the accumulator device 1 begins filling up again as described above, with drive 7 being stopped and drive 3 being started up.

Figure 5:
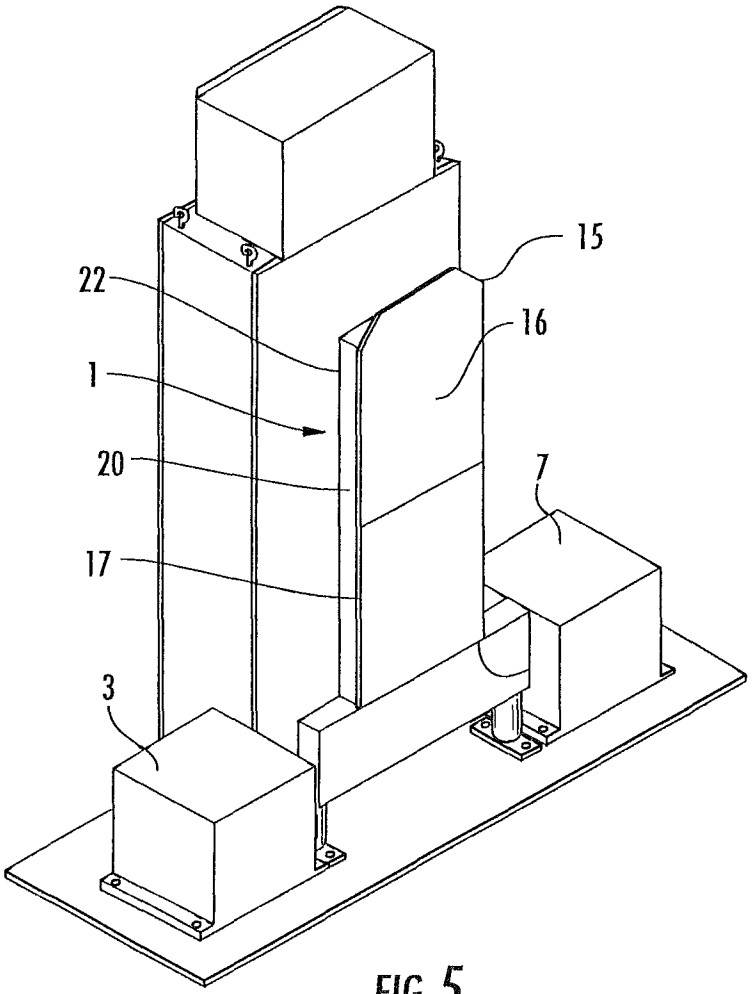
Figure 4:
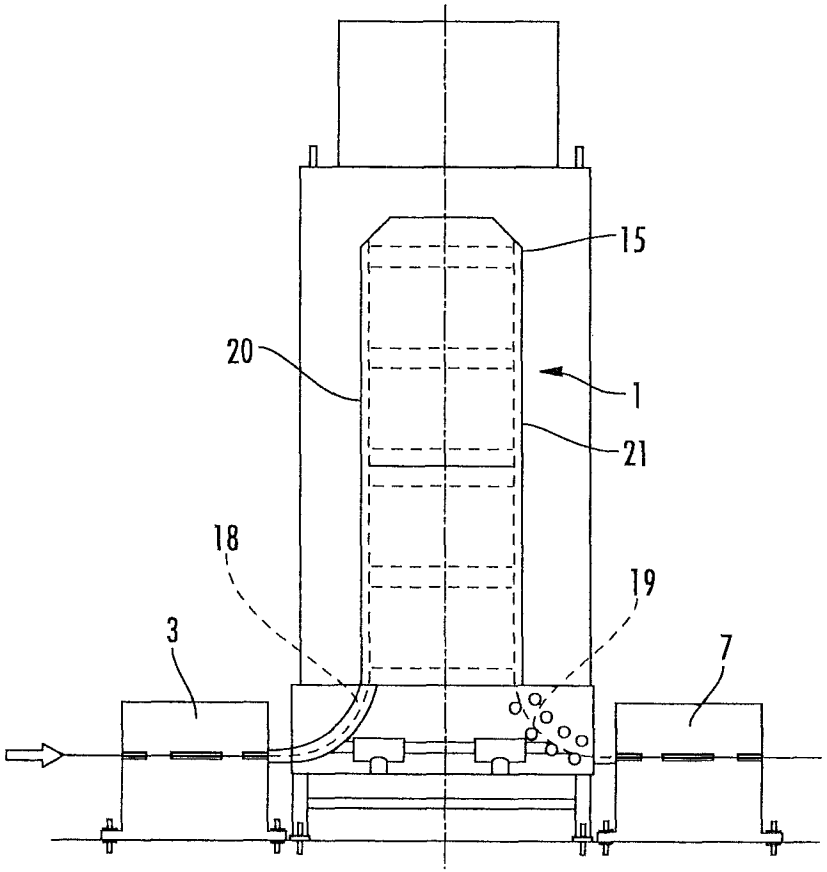

FIGS. 4 and 5 show a second embodiment of the invention, where the accumulator device 1 is designed as a so-called plate-type accumulator 15. The plate-type accumulator 15 consists of a largely hollow, very flat box whose large-surface side walls 16, 17 are very close to one another, the spacing being less than twice the diameter of the wire. The distance between the two side walls, 16, 17 should preferably be approximately 1.5 times the wire diameter. This will prevent the wire from falling in loops lying side by side, which would cause knots to form and consequently lead to a breakdown in operations. The rear side wall 17 is supported by a frame 22.

The accumulator device 1 in the embodiment shown in FIGS. 4 and 5 also has an inlet with a drive 3 and an outlet with a drive 7, similar to that shown in FIGS. 1 to 3. A curved guide 18 is located at the inlet area after the drive 3 and a curved guide 19 is arranged at the outlet area before the drive 7. The guides 18, 19 can be sliding plates, as shown for guide 18, or roller guides, as shown for guide 19. If necessary, the guides 18, 19 can also be extended upwards a little further along the end walls 20, 21 in order to provide a longer guided area for the wire. There are no guides or supporting devices for the wire between the guides 18, 19, which may have been extended further upwards, thus the wire between the guides 18, 19 lies in the path that meanders more or less loosely at random.

When a new tying wire is fed into the accumulator device for the first time, the guides 18, 19 are replaced by a straight guide not shown in the drawings and through which the wire runs in a straight line between the drives 3, 7 and through the accumulator device 1. Then the guides 18, 19 are used again. The change from guides 18, 19 to the straight guide can preferably also be performed automatically.

Compared to the embodiment according to FIGS. 1 to 3, this embodiment has the advantage of requiring very little design effort and having no structural mass that has to be moved during filling and emptying of the accumulator device 1 with tying wire, while the embodiment according to FIGS. 1 to 3 offers the advantage of controlled guiding of the tying wire into the accumulator device 1, thus interruptions in operation due to the wire jamming in the plate-type accumulator 15, which cannot be entirely excluded with certain wire gauges or grades, can be safely avoided.

On the other hand, the drives 3 and 7 of the two embodiments described above need not be stopped alternatively during filling and emptying of the accumulator device 1, but can be operated with a certain time overlap so that the accumulator device 1 can begin refilling again using drive 3 while the wire is removed using drive 7. This is possible due to the dynamic accumulating capacity of the accumulator, which allows wire removal from the drum and wire feed to the tying machine to proceed independently of one another. In this way, the cycle time for the tying machine can be shortened. Similarly, it is possible to refrain entirely from stopping the drive 3 during routine operations and leave it running at more or less constant speed, only operating drive 7 intermittently as required by the tying process. If the drives 3, 7 are driven with a certain time overlap or the first drive is not halted at all during operation of the device according to the invention, the maximum wire length that can be accumulated in the accumulator device 1 could also be shorter than the length required to fill the tying frame, thus the travelling distance of the movable roll group 5 in the embodiment shown in FIGS. 1 to 3 could be shorter, for example, because the accumulator device is replenished while the wire is being pulled out.

Viewed in feed direction of the tying wire, a measuring device to measure the length of tying wire to be fed in is located ahead of the accumulator device 1, preferably also ahead of the drive 3. When the end of the tying wire taken from the drum is reached, the leftover wire end must be disposed of before the length of tying wire required for the next tying operation has accumulated in the accumulator device. Since there is only a short piece of tying wire in the tying device 2, this can be achieved in a simple manner by pulling the front end of the leftover wire in the tying head 9 backwards until it reaches the compacting device 12. Then the drive 7 is switched again to the normal feed direction, the leftover wire is compacted in the compacting device 12 and ejected.

Instead of a measuring device, a simple facility for detecting the end of the tying wire can be placed ahead of the accumulator device 1, preferably ahead of the drive 3. As soon as this facility detects the end of the tying wire, the drive 3 is stopped and the leftover wire is disposed of as described above. This embodiment assumes that the length of wire to be fed to the accumulator device is measured or determined by other means, for example by using the drive as a stepping motor, whereby the forward feed length of the wire can be set exactly by means of the motor rotations or by setting the operating duration of the drive 3 according to the length of tying wire to be supplied.

The invention claimed is:

1. Accumulator device for tying wire in a tying machine, comprising:

a vertically elongated frame having an inlet side and an outlet side, an upper roll supported by the frame a distance above a lower roll supported by the frame, a roll guide extending vertically and fixed with respect to the frame, for guiding vertical movement of the upper roll within the frame whereby said distance between the upper and lower rolls is adjustable, a first drive mounted at the inlet side for receiving tying wire from a supply and urging the tying wire toward said rolls and a second drive mounted at the outlet side for receiving tying wire from said rolls and urging the tying wire away from the frame, wherein the tying wire passes from said first drive toward the frame where the wire engages the upper and lower rolls and loops at least twice around the upper roll and loops at least twice around the lower roll before passing to the second drive.

2. Accumulator device according to claim 1, wherein each of the upper and lower rolls comprises at least two discs arranged one beside the other.

3. The accumulator device of claim 1, wherein the upper roll defines a plurality of channels centered about a common upper centerline and the lower roll defines a plurality of channels centered about a different lower centerline at a vertical distance from the upper centerline, and said loops pass through said channels.

4. The accumulator device of claim 1, wherein the upper roll comprises at least two discs centered about a common upper centerline and arranged one beside the other, the lower roll comprises at least two discs centered about a common upper centerline and arranged one beside the other.

5. The accumulator device of claim 1, including a motor drive for moving said rolls relative to each other along the guide and thereby adjusting the distance between said rolls.

6. The accumulator device of claim 1, wherein each said roll has at least two channels adjacent to one another.

7. The accumulator device of claim 1, wherein the frame has horizontally spaced inlet and outlet sides that define a wire feed direction and vertically spaced bottom and top regions, the first drive at the inlet side feeds wire into the bottom region of the frame in the feed direction and the second drive delivers wire in the feed direction from the bottom region of the frame, the lower roll is stationary in the bottom region of the frame, and the upper roll is guided for vertical movement between the top and bottom regions of the frame.

8. The accumulator device of claim 1, wherein said accumulator device is operatively connected to deliver tying wire to a pulp bale tying machine.

9. The accumulator device of claim 7, including a motor drive for moving said rolls relative to each other along the guide and thereby adjusting the distance between rolls, and wherein said accumulator device is operatively connected to deliver tying wire to a pulp bale tying machine.

10. The accumulator device of claim 8, wherein wire loops at least three times around the upper roll and loops at least three times around the lower roll before passing to the second drive.

11. The accumulator device of claim 1, wherein said lower roll is positionally fixed to the frame.

* * * * *